US005331899A

United States Patent [19]

Holley

[11] Patent Number: 5,331,899

[45] Date of Patent: Jul. 26, 1994

[54] TIE PLATE MANIPULATOR VEHICLE AND METHOD

[75] Inventor: John D. Holley, Montgomery, Ala.

[73] Assignee: Holley Engineering Company, Inc., Montgomery, Fla.

[21] Appl. No.: 66,245

[22] Filed: May 25, 1993

[51] Int. Cl.[5] ..... E01B 29/32

[52] U.S. Cl. ..... 104/16

[58] Field of Search ..... 104/2, 5, 6, 17.2; 198/394, 395, 402, 406

[56] References Cited

U.S. PATENT DOCUMENTS

| | | | |
|---|---|---|---|
| 3,795,301 | 3/1974 | Sugitani | 198/20 R |
| 3,842,965 | 10/1974 | Pfaffle | 198/103 |
| 4,225,429 | 9/1980 | Holley | 209/215 |
| 4,241,663 | 12/1980 | Lund et al. | 104/16 |
| 4,280,613 | 7/1981 | Stewart | 108/426 |
| 4,478,152 | 10/1984 | Holley | 104/279 |
| 4,691,639 | 9/1987 | Holley | 104/16 |
| 4,722,283 | 2/1988 | Holley | 104/279 |
| 4,940,001 | 7/1990 | Holley | 104/307 |
| 4,974,518 | 12/1990 | Cotic et al. | 104/16 |
| 5,067,412 | 11/1991 | Theuer et al. | 104/16 |

*Primary Examiner*—Mark T. Le

*Attorney, Agent, or Firm*—Kerkam, Stowell, Kondracki & Clarke

[57] ABSTRACT

Tie plates are moved between a position on a tie plate manipulator vehicle and a track position, which is under a rail and above a tie. A magnetic wheel is used in conjunction with a rail lifter. The rail lifter lifts the rail while the magnetic wheel installs or removes a tie plate from between a tie and a rail. The vehicle may include another magnetic wheel used for picking up tie plates loosely placed upon ties. A ballast sweeper or broom with a rotary core may be incorporated into the vehicle.

20 Claims, 4 Drawing Sheets

TIE PLATE MANIPULATOR VEHICLE AND METHOD

BACKGROUND OF THE INVENTION

The present invention relates to a tie plate manipulator vehicle and associated method of using the vehicle to apply and/or remove tie plates from between the underside of rails and the top surface of railroad cross ties.

It is often necessary to replace some railroad ties in an existing railroad track. Various machines are used as part of this process.

A spike puller machine pulls spikes which hold tie plates to the cross-ties of the railroad track. The spikes may be processed for reuse manually or, more preferably, by using the present inventor's rail spike cleaning apparatus described in U.S. Pat. No. 4,940,001 issued Jul. 10, 1990 and hereby incorporated by reference. Those ties which are to be replaced and which have anchors adjacent to them must have the anchors spread away from the ties. This may advantageously be accomplished by using the present inventor's anchor spreader apparatus as described in U.S. Pat. No. 4,903,611 issued on Feb. 27, 1990 and hereby incorporated by reference. The general process next would include removal of the tie by using one of various known machines slide the tie out from under the rails. Since the tie plates are no longer fastened to the ties by the previously removed spikes, the tie plates are usually manually placed on ties which are adjacent to the ties which must be removed. A tie inserter machine (might be the same machine as the tie remover) inserts a new tie underneath the rails.

After insertion of the new tie, a ballast sweeper or broom machine having a rotary core and various sweeper elements is used to sweep ballast (the rock, usually limestone, used for the roadbed) off the top of the newly inserted tie. After the newly inserted tie or ties have been swept clean, a vehicle having a rail lifter is used to lift the rails up and away from the newly inserted tie, whereupon the tie plates, previously placed manually adjacent to the location of the tie being replaced, are manually placed underneath the rails and on the top surface of the newly inserted tie. The rail lifter or lifters then release the rails such that they drop into the rail receiving portions of the tie plates. Next, a spiker vehicle would be used to insert new or reclaimed spikes into the spike holes of the tie plates on the new tie.

Although the known technique generally works, it is subject to a number of disadvantages. In particular, the requirement for manually inserting the tie plates under the rails adds significant labor costs to the overall operation. Depending upon the care of the workers and the reliability of the rail lifter, manual insertion of the tie plates under the lifted rail may raise safety concerns. In order to accomplish the manual placement of tie plates under the rails, one worker is usually used on each side of the railroad track. Depending upon the reliability of the two workers and their energy level, the efficiency and time required to replace the tie plates varies significantly.

In addition to the requirement for the laborers to manually place the tie plates under the rails after the new tie is inserted, the generally used technique requires laborers to collect or remove tie plates from a tie which is being replaced. Again, this is physically demanding work which adds significantly to the overall labor cost of the tie replacement process.

OBJECTS AND SUMMARY OF THE INVENTION

Accordingly, it is a primary object of the present invention to provide a new and improved tie plate manipulator vehicle and associated method for replacing tie plates when ties are being removed and replaced.

A more specific object of the present invention is to provide for tie plate manipulation which lowers the labor cost associated with replacing tie plates as part of a tie replacement process.

A further object of the present invention is to provide efficient, reliable, safe, and relatively fast placement of tie plates upon newly inserted ties.

A still further object of the present invention is to reduce the number of vehicles used as part of a tie replacement operation.

The above and other objects of the present invention which will become more apparent as the description proceeds are realized by a tie plate manipulator vehicle including a frame and at least four rail engagement wheels mounted thereto for moving the tie plate manipulator vehicle along a pair of rails. A rail lifter is mounted to the frame and operable to lift a rail, which extends in a rail direction, away from a tie disposed therebelow. A tie plate manipulator assembly is supported by the frame. The tie plate manipulator assembly includes a magnetic wheel rotatable about an axis extending along the rail direction, a support movably mounted to the frame and attached to the magnetic wheel and supporting the magnetic wheel just above the tie and adjacent the rail lifter, and a motor connected to rotate the magnetic wheel such that the magnetic wheel moves tie plates between a top position above the magnetic wheel and a track position on a tie underneath a rail, while the rail lifter has lifted the rail.

A first embodiment of the manipulator vehicle has the motor rotating the magnetic wheel such that the magnetic wheel moves the tie plates from the track position to the top position, thus pulling tie plates off of ties and out from underneath rails. A second embodiment has the motor rotating the magnetic wheel such that the magnetic wheel moves tie plates from the top position to the track position, thus moving tie plates from the vehicle itself down to a tie and underneath a rail.

The second embodiment includes a tie plate supporting zone supported by the frame with the tie plate manipulator assembly further including a first conveyance means for moving tie plates between the tie plate supporting zone and the magnetic wheel. A gate supplies one tie plate at a time from the tie plate supporting zone to the first conveyance means.

The support includes at least one arm having a pivot end pivotably supported (i.e., directly or indirectly) by the frame at a pivot point and a wheel end to which the magnetic wheel is mounted. A magnetic wheel lift cylinder is attached to the arm and supports the weight of the magnetic wheel such that tie plates may pass between the top position and the track position by way of a lowest point on the magnetic wheel.

The vehicle may further include a pickup wheel supported by the frame and with magnets therein operable to pick up tie plates disposed loosely on ties. A second conveyance means for carrying tie plates picked up by the pickup wheel to the tie plate holding zone is provided. An intermediate wheel is operable to convey tie plates from the pickup wheel to the second conveyance means. The first conveyance means is a chute and the second conveyance means is a conveyor belt extending around the intermediate wheel. The vehicle may further include a rotary ballast sweeper supported by the frame.

The method according to the present invention is a method of manipulating tie plates using a tie plate manipulator vehicle. A rail lifter on the tie plate manipulator vehicle is actuated to lift a rail. A magnetic wheel mounted to the tie plate manipulator vehicle is rotated about a rail direction axis to move a tie plate between a top position above the magnetic wheel and a track position beneath the lifted rail and above a tie. A first embodiment of the method involves the rotating step moving a tie plate from the track position to the top position. A second embodiment of the method involves the rotating step moving a tie plate from the top position to the track position.

The method may further include the steps of releasing tie plates one at a time from a tie plate holding zone on the tie plate manipulator vehicle to a conveyance means, and conveying tie plates on the conveyance means to the magnetic wheel. A further step may include picking up tie plates disposed loosely on ties using a pickup wheel on the tie plate manipulator vehicle with magnets therein.

BRIEF DESCRIPTION OF THE DRAWINGS

The above and other features of the present invention will be more readily understood when the following detailed description is considered in conjunction with the accompanying drawings wherein like characters represent like parts throughout the several views and in which.

DETAILED DESCRIPTION

Figure 1:
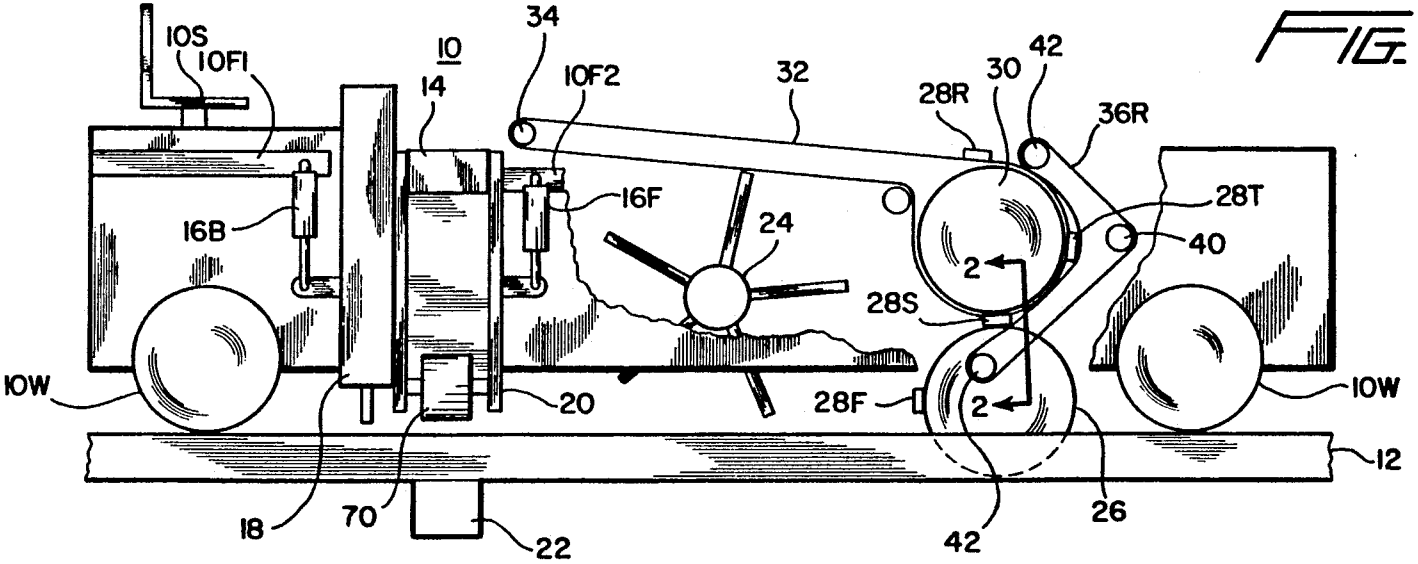
FIG. 1 is a simplified, schematic, side view of a vehicle according to the present invention.

FIG. 1 shows the overall machine 10 according to the present invention. The machine 10 is a tie plate manipulator vehicle having four wheels 10W for engaging rails 12 in a railroad track. Only two of the four wheels 10W and one of the rails 12 is visible from the side view of FIG. 1. The vehicle 10 further includes an operator seat 10S and a frame including portions 10F1 and 10F2.

A work head 14 is mounted to the frame members 10F1 and 10F2 by way of front and back hydraulic cylinders 16F and 16B respectively. The cylinders 16F and 16B are operable to raise and lower the work head 14. It will be readily appreciated that the positioning of cylinders 16F and 16B could alternately extend down to a portion of the frame (not separately shown) extending along or near the bottom of the vehicle 10 or could have any of numerous other orientations provided that it lift and lower the work head 14. Additionally, the work head 14 includes a rail lifter 18 and a tie plate manipulator assembly 20. If desired, the rail lifter 18 and tie plate manipulator assembly 20 could have separate hydraulic jacks (not shown) so as to lift and lower one without the other.

The details of operation of the work head 14 will be discussed below. Generally though, the rail lifter 18 will lift the rail 12, while the tie plate manipulator assembly 20 will place a tie plate (not separately shown) on the tie, such as tie 22 and below the rail 12. It should be understood that a work head (not shown), identical in operation and construction to right side work head 14, would be disposed on the left side of the vehicle 10 so that tie plates could be placed simultaneously under both of the rails 12 supported by tie 22.

Advantageously, the tie plate manipulator vehicle 10 may include a rotary core ballast broom or sweeper 24 (depicted schematically). This broom may be constructed in any of various well known fashions. If desired, it may also utilize various dust control techniques as described in more detail in the present inventor's application serial number (Docket No. 4358) filed Apr. 23, 1993 entitled "Ballast Sweeper Dust Control" and hereby incorporated by reference.

The vehicle 10 may also include an arrangement to pick up tie plates which may have been previously left upon cross ties (which cross ties are not to be replaced). Specifically, that arrangement may include magnetic pickup wheel 26. The magnetic pickup wheel 26 is used to pick up tie plates such as first, second, third, and fourth tie plates 28F, 28S, 28T, and 28R, shown at various stages in the processing, and which had previously been placed loosely upon ties (which are not being replaced as part of the process). The pickup wheel 26 conveys tie plates to an intermediate wheel 30 which releases the tie plates at the position of tie plate 28R to an endless belt conveyor 32 extending from pulley 34 to and around the intermediate wheel 30. The intermediate wheel 30 may be a magnetic wheel similar to pickup wheel 26. The construction details of the pickup wheel 26 and intermediate wheel 30 need not be given as such magnetic wheels are relatively well known. However, reference may be had to the present inventor's prior U.S. Pat. Nos. 4,691,639 issued Jul. 8, 1987, 4,722,283 issued Dec. 28, 1987, and 4,940,001 issued Nov. 4, 1988. Those patents are hereby incorporated by reference. Since those patents and numerous others describe the construction details for various magnetic wheels, such details will not be presented herein.

Figure 2:
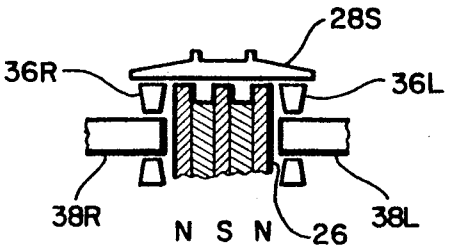
FIG. 2 is a simplified cross-section view, with parts broken away, taken along lines 2—2 of FIG. 1.

Continuing to view FIG. 1, but also referring to the cross section view of FIG. 2, the manner in which tie plates such as tie plate 28S are transferred from pickup wheel 26 to intermediate wheel 30 will be discussed. Right and left tension belts 36R and 36L (only 36R is visible in FIG. 1) extend around pulleys 38R and 38L (only 38R is visible in FIG. 1) and pulleys 40 and 42 (FIG. 1 only). The rotation of magnetic wheel 26 from a hydraulic or other motor (not shown) causes the pickup wheel 26 to pick up tie plates. As the wheel 26 moves clockwise in the view of FIG. 1, tie plates move from position 28F to the position corresponding to tie plate 28S. At that point, and with reference especially to FIG. 2, the tension belts 36R and 36L would pull tie plate 36S away from the periphery of magnetic wheel 26 (shown with pull markings N and S in FIG. 2). Although not shown, the tension belts 36R and 36L may include little ridges or other gripping mechanisms and the belts 6R and 36L may be driven. Other arrangements could of course be used. For example, the intermediate wheel 30 could simply be a pulley or sprocket for conveyor belt 32 which might have grippers thereon to move tie plate from 28S to 28R without any magnetic blocks in wheel 30. The conveyor belt 32 carries tie plates to a magazine portion of the tie plate manipulator assembly 20, which will be discussed in more detail below.

The pickup wheel 26, intermediate wheel 30, and conveyor belt 32 supply tie plates to the tie plate manipulator assembly 20 illustrated in FIG. 1. As discussed previously, the tie plate manipulator assembly 20 and rail lifter 18 of FIG. 1 are on the right side of the vehicle and there are identical components on the left side of the vehicle. In similar fashion, there may also be identical structures on the left side of the vehicle corresponding to the right side pickup wheel 26, intermediate wheel 30, conveyor belt 32, and associated components.

Figure 3:
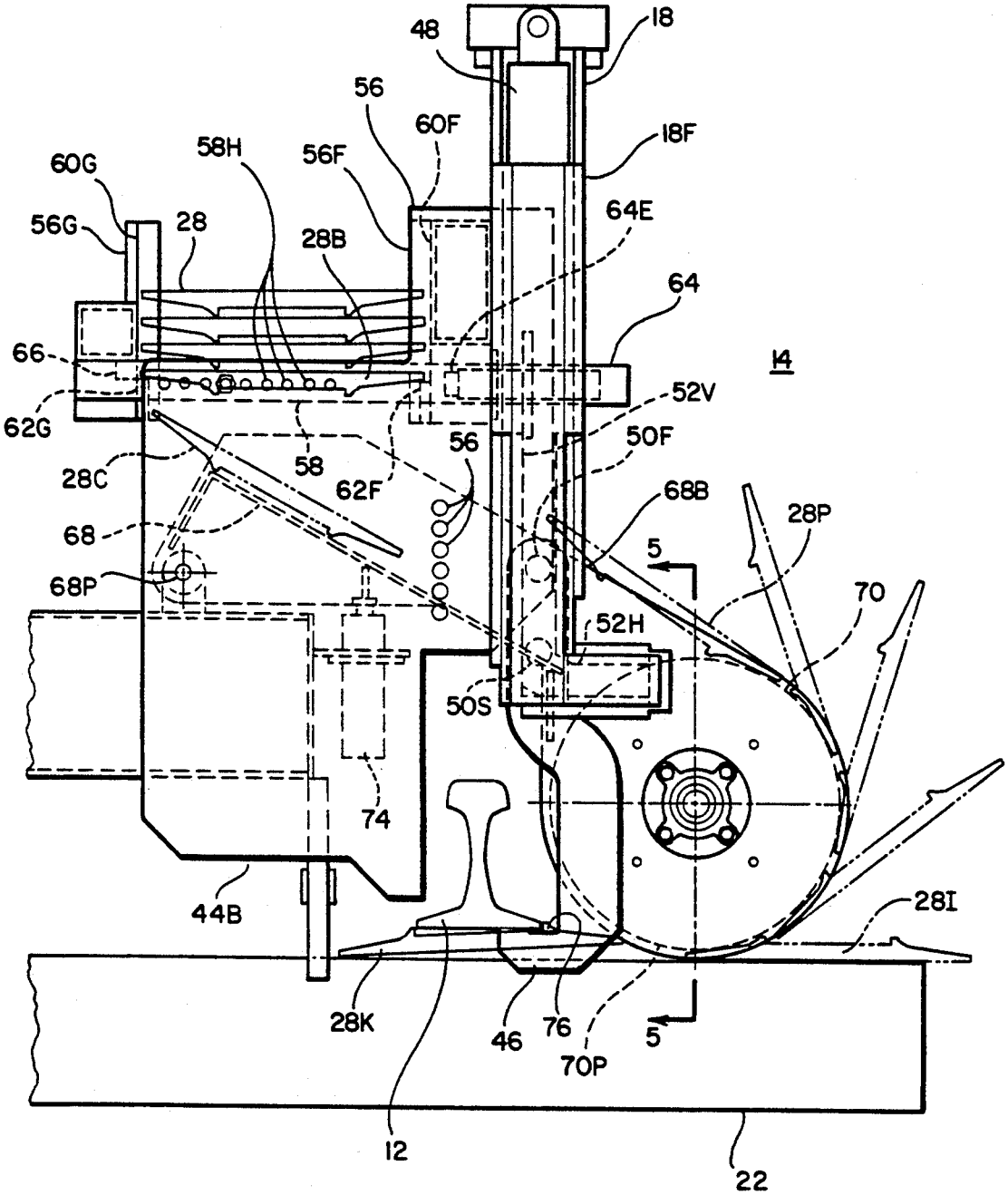
FIG. 3 is a back view of a work head including a tie plate manipulator assembly and associated components.
Figure 4:
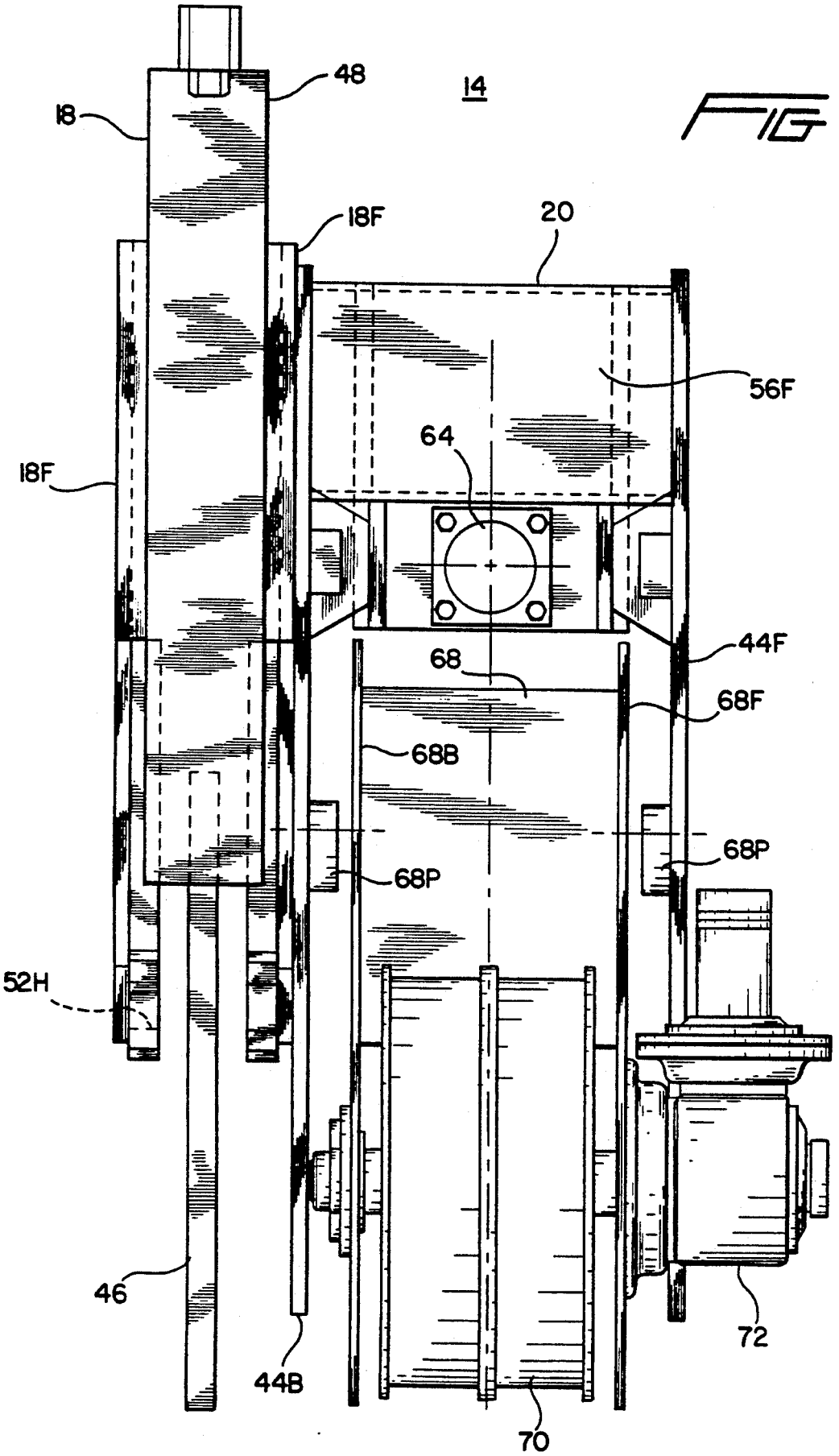
FIG. 4 is a side view of the components of FIG. 3.

Turning now to FIGS. 3 and 4, more of the details of the work head 14 will be discussed. The work head 14 includes a work head frame members 44F and 44B. The remainder of the work head 14 including both rail lifter 18 and tie plate manipulator assembly 20 are supported by the members 44F and 44B. The members 44F and 44B would be moved up and down by the hydraulic cylinders 16F and 16B (refer back momentarily to FIG. 1 for the cylinders).

Any of various known constructions may be used for the rail lifter 18. Although not illustrated, some known constructions include members which latch to a rail from opposite sides of the rail. However, a brief description of the particular rail lifter 18 illustrated will be presented. As seen in FIG. 3, the rail lifter 18 includes a hook mounted to an end of a hydraulic cylinder 48 disposed within rail lifter frame members 18F.

With reference especially to FIG. 3, the hook 46 uses a camming arrangement to lift the rail 12. In particular, first and second circular cams 50F and 50S are fixed to the hook 46. The cams 50F and 50S are constrained to move in a channel including a vertical portion 52V and a horizontal portion 52H. With the hydraulic cylinder 48 fully extended, the hook 46 would be rotated 90° from the position illustrated in FIG. 3. The cams 50F and 50S would be disposed in the horizontal channel portion 52H. As the hydraulic cylinder 48 is retracted, the hook 46 is pulled up with the cams 50F and 50S being pulled from the horizontal channel portion 52H into the vertical channel portion 52V. This causes the hook 46 to pivot clockwise about cam 50F (also where the hook 46 is pivotably attached to a rod end, not separately shown, of cylinder 48) and into the position shown in FIG. 3 or just below the illustrated position. The cam-induced pivoting of hook 46 causes its lower end to pivot underneath the rail 12 just to the side of the tie 22. As the hydraulic cylinder 48 continues to retract, the hook 46 pulls the rail 12 up to the position illustrated in FIG. 3 where it is offset from the tie 22. If desired, a series of stop holes 56 could be used to mount a stop (not separately shown) such as a bolt or other member which would block retraction of the hook 46 or cylinder 48 beyond a certain point. The series of holes 56 are vertically offset from each other so that one could selectively put the stop in different positions depending upon the amount one wished to lift the rail 12.

Continuing to view FIG. 3 and FIG. 4 together, the construction of the tie plate manipulator assembly will be discussed in more detail. The top of the tie plate manipulator assembly 20 has a tie plate magazine 56 having a gauge side portion 56G and a field side portion 56F adjustably attached thereto by arms 58 (only one visible in the view of FIG. 3). Holes 58H in arms 58 allow the distance between the fixed field side 56F portion of the magazine and the adjustable gauge side portion 56G to be adapted for different size tie plates such as tie plates 28 illustrated in FIG. 3.

As illustrated, the tie plates are disposed between sidewalls 60G and 60F on the gauge and field side respectively. At the bottom of the sidewalls 60G and 60F are ledges 62G and 62F respectively, which support the bottom tie plate 28B. When a tie plate is to be released from the tie plate holding zone or magazine 56, a tie plate release cylinder 64 extends out a rod end 64E which bumps the field side of the bottom tie plate 28B and pushes it toward the gauge side, thus freeing it from ledge 62F. The gauge side of tie plate 28B may travel into a recess 66 in the sidewall 60G. As the end 64E of release cylinder 64 retracts, the next tie plate will be constrained by the ledges 62G and 62F until the release cylinder 64 releases it.

After the release of a tie plate such as tie plate 28B, it will drop into the position shown for tie plate 28C which is at the top of a chute 68 which simply provides a planar slide located between front and back side members 68F and 68B (FIG. 4). As shown in FIG. 4, the chute side members 68F and 68B serve as a frame in which a rotatable magnetic wheel 70 is mounted. The magnetic wheel 70 is rotated under the power of a hydraulically operated motor 72, which is mounted to members 68F.

Figure 5:
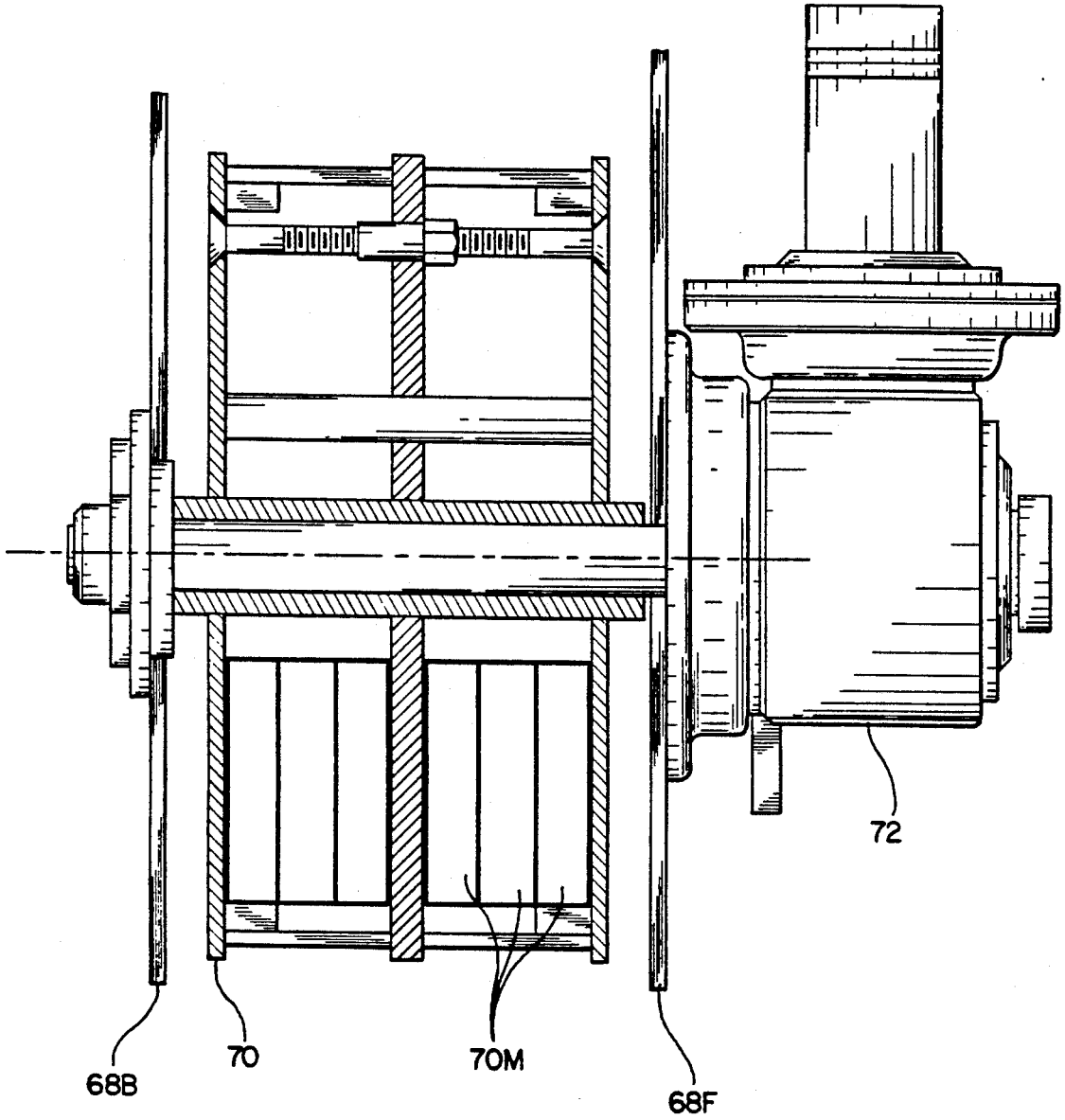
FIG. 5 is a cross sectional view taken along lines 4—4 of FIG. 3.

With reference now to FIG. 5, the cross section of magnetic wheel 70 shows that it includes block magnets 70M. As the construction of such magnetic wheels is described in detail in the present inventor's above incorporated by reference patents, further construction details need not be presented herein.

Turning back to FIG. 3, a tie plate such as tie plate 28C deposited on the top of chute 68 is carried by gravity to the bottom of the chute 68, whereupon the magnetic wheel 70 will carry it around clockwise from a top position 28P to a track position 28K disposed above tie 22 and below rail 12. Various intermediate positions are illustrated for the tie plates including position 28I when the tie plate is disposed on the tie 22. As the magnetic wheel 70 turns further clockwise, a tie plate in position 28I is pulled under the lowest point 70P of the periphery of magnetic wheel 70 and into the position 28K. In order to allow the tie plate to be pulled under the magnetic wheel, the members 68F and 68B are pivotable about pivots 68P (shown in simplified form in FIG. 4) relative to frame members 44F and 44B.

A magnet wheel lift cylinder 74 (FIG. 3 only) is mounted to member 44B and is used to lift and lower magnet wheel 70 by pivoting about pivots 68P. However, the lift cylinder 74 would be used in a float mode such that it supports most of the weight of the various components mounted to chute frame members 68F and 68B. In that fashion, the magnetic wheel 70 is not weighted against the tie 22. As a tie plate is pulled underneath the magnetic wheel 70, the lift cylinder 74 allows a slight pivoting about pivots 68P such that the tie plate may slide under the lowest point 70P and over to the position illustrated for tie plate 28K. Advantageously the magnetic wheel 70 lifts the field side of the tie plate 28K such that its lip 76 binds against the base of rail 12, thus stalling the magnetic wheel drive motor 72 such that a relief valve (not shown) will open to avoid an over pressure condition in a manner well known for hydraulic circuits. At that stage, the hydraulic cylinder 48 of rail lifter 18 can be extended such that hook 46 will be lowered from its FIG. 3 position and will be pivoted counterclockwise 90°. The rail 12 will be lowered into the tie plate 28K. A similar operation would be performed for the rail unseen in FIG. 3, but which would be located at the opposite end of tie 22.

A brief overview of the overall operation of the work head 14 may be helpful with reference to FIGS. 1 and primarily FIG. 3. Upon the magnetic wheel 70 being disposed over a tie 22, upon which tie plates are to be inserted underneath the rail 12, hydraulic cylinders 16F and 16B (FIG. 1 only) are extended to lower the work head 14 including rail lifter 18 and tie plate manipulator assembly 20. As the work head 14 is being lowered, this automatically causes the tie plate release cylinder 64 to release a single tie plate. The released tie plate falls down the chute 68 to the top of magnet wheel 70. The hydraulic cylinder 48 of rail lifter 18 starts retracting causing the hook 46 to hook underneath the rail 12 and begin lifting it. At the same time as the hydraulic cylinder 48 is retracting, the magnetic wheel 70 will begin turning to rotate the tie plate around from position 28P to position 28K. In other words, the same control which causes the rail lifter 18 to begin retracting hydraulic cylinder 48 for lifting the rail 12 also causes the magnetic wheel drive motor 72 to turn the magnetic wheel 70.

Figure 6:
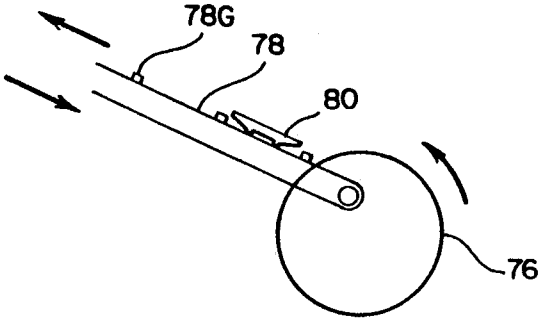
FIG. 6 is a simplified back view of a modified tie plate manipulator assembly and associated components.

Although the tie plate manipulator assembly 20 and magnetic wheel 70 have been discussed in terms of placing a tie plate underneath a rail 12 and above a tie 22, an alternative arrangement is shown schematically in FIG. 6 wherein a magnetic wheel 76, constructed in similar fashion to magnetic wheel 70 is used to rotate counterclockwise so as to deposit tie plates upon a conveyor belt 78 having gripping members 78G disposed thereon. The tie plate such as tie plate 80 in FIG. 6 would be stripped away from the magnetic wheel 76 by the conveyor belt 78, using a technique similar to that shown for FIG. 2 where the two tension belts 36R and 36L strip the tie plate 28S away from the magnetic pickup wheel 26. The conveyor belt 78 may be one of two belts on opposite sides of the magnetic wheel 76. Alternately, various stripper members (not shown) may be used in a fashion similar to that described in the present inventor's incorporated by reference patents.

Although not illustrated in FIG. 6, the arrangement shown in FIG. 6 would have the magnetic wheel 76 mounted adjacent to a rail lifter as discussed with respect to the arrangement of FIG. 1. Upon the rail lifter lifting the rail, an old tie plate (from which spikes had previously been removed) would be pulled from a position corresponding to that of 28K in FIG. 3 to a position corresponding to 28P in FIG. 3. The tie plate would then be pulled along a conveyor as illustrated by tie plate 80 in FIG. 6. Although not illustrated, the tie plate could be fed into a chute or another conveyor which would deposit the tie plate upon a tie which was not being replaced.

Basically, FIG. 6 is simply illustrating that the mechanisms shown in FIG. 3, with the slight modification of using a conveyor instead of chute 68, may be used to pull tie plates out from under rails for the ties 22 which are going to be replaced.

Following the removal of a tie plate using the principle of FIG. 6, a tie inserter/remover vehicle (not shown) would be used to replace the tie, after which the vehicle 10 of FIG. 1 could be used for inserting a new or recycled tie plate upon the newly installed tie. Thus, the present invention contemplates avoiding the need for manual labor to remove the tie plates from old ties which are going to be removed and avoiding the need for manual labor for installing tie plates in the new ties.

The above description includes various construction details, but it will be readily understood that these are for illustrative purposes only. Various modifications will be apparent to those of skill in the art. Accordingly, the scope of the present invention should be determined by reference to the claims appended hereto.

What is claimed is:

1. A tie plate manipulator vehicle comprising:

a frame and at least four rail engagement wheels mounted thereto for moving the tie plate manipulator vehicle along a pair of rails;

a rail lifter mounted to said frame and operable to lift a rail, which extends in a rail direction, away from a tie disposed therebelow;

a tie plate manipulator assembly supported by said frame and including a magnetic wheel rotatable about an axis extending along said rail direction, a support movably mounted to said frame and attached to said magnetic wheel and supporting said magnetic wheel just above a tie and adjacent said rail lifter, and a motor connected to rotate said magnetic wheel such that said magnetic wheel moves tie plates between a top position above said magnetic wheel and a track position on a tie underneath a rail, while said rail lifter has lifted the rail.

2. The tie plate manipulator vehicle of claim 1 wherein said motor rotates said magnetic wheel such that said magnetic wheel moves tie plates from the track position to the top position.

3. The tie plate manipulator vehicle of claim 1 wherein said motor rotates said magnetic wheel such that said magnetic wheel moves tie plates from the top position to the track position.

4. The tie plate manipulator vehicle of claim 3 further comprising a tie plate supporting zone supported by said frame and wherein said tie plate manipulator assembly further includes first conveyance means for moving tie plates between said tie plate supporting zone and said magnetic wheel.

5. The tie plate manipulator vehicle of claim 4 further comprising a gate for supplying one tie plate at a time from said tie plate supporting zone to said first conveyance means.

6. The tie plate manipulator vehicle of claim 4 wherein said support includes at least one arm having a pivot end pivotably supported by said frame at a pivot point and a wheel end to which said magnetic wheel is mounted, and further comprising a magnetic wheel lift cylinder attached to said arm and supporting the weight of said magnetic wheel such that tie plates may pass between said top position and said track position by way of a lowest point on said magnetic wheel.

7. The tie plate manipulator vehicle of claim 6 further comprising a pickup wheel supported by said frame and with magnets therein operable to pick up tie plates disposed loosely on ties.

8. The tie plate manipulator vehicle of claim 7 further comprising a second conveyance means for carrying tie plates picked up by said pickup wheel to said tie plate holding zone.

9. The tie plate manipulator vehicle of claim 8 further comprising an intermediate wheel operable to convey tie plates from said pickup wheel to said second conveyance means.

10. The tie plate manipulator vehicle of claim 9 wherein said first conveyance means is a chute and said second conveyance means is a conveyor belt extending around said intermediate wheel.

11. The tie plate manipulator vehicle of claim 10 further comprising a rotary ballast sweeper supported by said frame.

12. The tie plate manipulator vehicle of claim 4 further comprising a pickup wheel supported by said frame and with magnets therein operable to pick up tie plates disposed loosely on ties, and further comprising a second conveyance means for carrying tie plates picked up by said pickup wheel to said tie plate holding zone.

13. The tie plate manipulator vehicle of claim 3 wherein said support includes at least one arm having a pivot end pivotably supported by said frame at a pivot point and a wheel end to which said magnetic wheel is mounted, and further comprising a magnetic wheel lift cylinder attached to said arm and supporting the weight of said magnetic wheel such that tie plates may pass between said top position and said track position by way of a lowest point on said magnetic wheel.

14. The tie plate manipulator vehicle of claim 1 wherein said support includes at least one arm having a pivot end pivotably supported by said frame at a pivot point and a wheel end to which said magnetic wheel is mounted, and further comprising a magnetic wheel lift cylinder attached to said arm and supporting the weight of said magnetic wheel such that tie plates may pass between said top position and said track position by way of a lowest point on said magnetic wheel.

15. The tie plate manipulator vehicle of claim 1 further comprising a tie plate supporting zone supported by said frame and wherein said tie plate manipulator assembly further includes first conveyance means for moving tie plates between said tie plate supporting zone and said magnetic wheel, and further comprising a gate to supply one tie plate at a time from said tie plate supporting zone to said first conveyance means.

16. A method of manipulating tie plates using a tie plate manipulator vehicle, the steps comprising:

actuating a rail lifter on the tie plate manipulator vehicle to lift a rail; and rotating, about a rail direction axis, a magnetic wheel mounted to the tie plate manipulator vehicle to move a tie plate between a top position above the magnetic wheel and a track position beneath the lifted rail and above a tie.

17. The method of claim 16 wherein said rotating moves a tie plate from the track position to the top position.

18. The method of claim 16 wherein said rotating moves a tie plate from the top position to the track position.

19. The method of claim 18 further comprising the steps of:

releasing tie plates one at a time from a tie plate holding zone on the tie plate manipulator vehicle to a conveyance means; and conveying tie plates on the conveyance means to the magnetic wheel.

20. The method of claim 19 further comprising the step of picking up tie plates disposed loosely on ties using a pickup wheel on the tie plate manipulator vehicle with magnets therein.

* * * * *